United States Patent [19]

Spooner et al.

[11] 3,960,286

[45] June 1, 1976

[54] AUTOMATIC OVERLOAD CONTROL FOR A COUNTERBALANCED LIFT TRUCK

[75] Inventors: Ronald E. Spooner, Richton Park; Terry R. Downing, Matteson, both of Ill.

[73] Assignee: Allis-Chalmers Corporation, Milwaukee, Wis.

[22] Filed: Dec. 19, 1974

[21] Appl. No.: 534,454

[52] U.S. Cl. ..... 214/674; 91/411 R; 91/412

[51] Int. Cl.[2] ..... B66F 9/20

[58] Field of Search..... 214/674; 91/411 R, 412; 187/17, 9; 137/596.18

[56] References Cited

UNITED STATES PATENTS

| | | | |
|---|---|---|---|
| 3,007,593 | 11/1961 | Hancock | 214/674 |
| 3,831,492 | 8/1974 | Young | 91/412 |
| 3,850,323 | 11/1974 | Ekstrom | 91/412 |

*Primary Examiner*—Robert J. Spar
*Assistant Examiner*—Lawrence J. Oresky
*Attorney, Agent, or Firm*—Charles L. Schwab

[57] ABSTRACT

When the load moment on a counterbalanced lift truck exceeds a predetermined magnitude, a blocking valve automatically prevents forward tilting of the mast and elevation of the load. The load moment is sensed by the pressure differential across the tilt jack and the blocking valve is actuated by the pressure differential. In order to prevent the blocking valve from becoming locked up, when the tilt jack is contracted to the end of its stroke, a spring-biased unloading valve is incorporated in the tilt jack piston. Abuse of the truck is reduced and operator safety is improved further by the provision of a second blocking valve which prevents lifting loads when the tilt jack is at the end of its extension stroke, that is when the mast is tilted forwardly as far as permitted by the tilt jack. In this condition the second blocking valve will close preventing further raising of the load. However, retraction of the tilt and lift jacks is permitted even though the blocking valves are in their closed positions. The second blocking valve is biased toward its open position by the pressure in the rod end of the tilt jack and toward its closed position by the pressure in the lift jack. The blocking valves are biased toward their open positions by adjustable spring means which permit the control system to be adjusted to meet the protection requirements of lift trucks with different load carrying capacities. Pressure modulating restrictors are provided in pilot lines to the blocking valves to prevent false actuation when pressure fluctuations occur.

9 Claims, 2 Drawing Figures

AUTOMATIC OVERLOAD CONTROL FOR A COUNTERBALANCED LIFT TRUCK

BACKGROUND OF THE INVENTION

This invention relates to an automatic operating overload control for counterbalanced lift trucks and particularly to an overload control sensitive to the load moment which operates to prevent further forward tilting of the mast or raising of the load thereby preventing the operator from increasing the danger of overturning the vehicle during material handling operations.

Various systems have been proposed for preventing excessive forward overturning moment in a counterbalanced lift truck. Among these are systems responsive to the tilt jack differential pressure such as shown in U.S. Pat. No. 3,007,593 to K. G. Hancock and U.S. Pat. No. 3,831,492 to M. R. Young.

SUMMARY OF THE INVENTION

The present invention relates to an automatic overload protection system for a counterbalanced vehicle, such as a lift truck, wherein the differential pressure across the tilt jack piston is utilized to actuate control valves to prevent further forward tilting or elevation of the load. The automatic control is designed to permit rearward tilting and lowering of the load even though forward tilting and raising of the load is prevented. An unloading valve is incorporated in the piston of the tilt jack which opens to permit flow between opposite sides of the tilt jack piston when the jack is near the end of its contraction stroke. This prevents locking up of the differential pressure operated valve when the tilt jack piston is bottomed out at the end of its contraction stroke. Automatic valve means are also provided to prevent raising the load when the mast is tilted forwardly to where the tilt jack piston bottoms out on the rod end of the tilt jack cylinder. Adjustable spring means are provided for the automatic tilt and lift control valves which permit the sensitivity of the system to be adjusted thus allowing the control to be used on different capacity trucks. Pressure modulating means are incorporated in pilot lines to the differential pressure operated valves to prevent their being falsely actuated by wide swinging pressure fluctuations.

BRIEF DESCRIPTION OF THE DRAWINGS

The invention as incorporated in a counterbalanced lift truck is shown in the drawings wherein.

DETAILED DESCRIPTION

Figure 1:
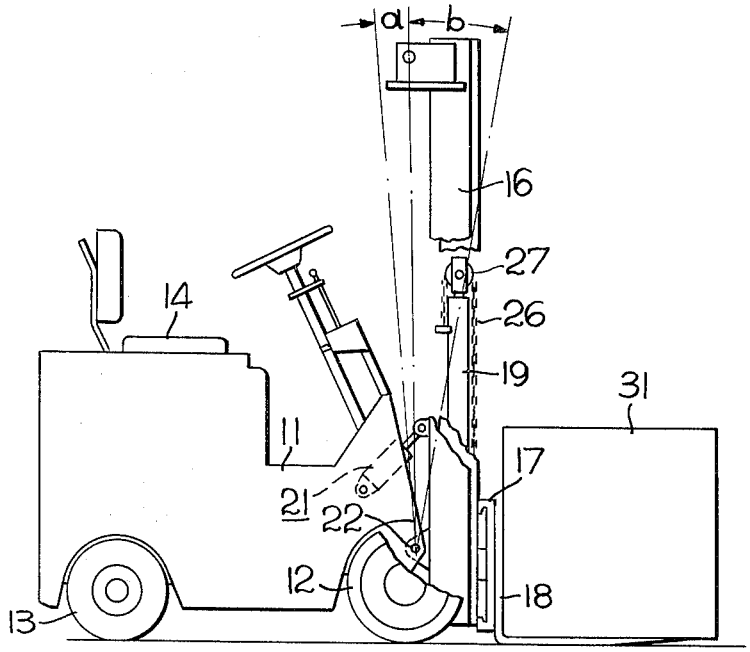
FIG. 1 is a side view of a lift truck.

The counterbalanced lift truck shown in FIG. 1. includes a main frame 11, a pair of front drive wheels 12, a pair of rear steerable wheels 13, an operator's seat 14, a vertical mast 16, a carriage 17 with lift forks 18, a single acting lift jack 19 and a double acting tilt jack 21. The mast 16 is pivotally connected to the frame 11 on a transverse pivot axis by pins 22 and the tilt jack 21 maintains the mast in the desired upright position by expansion or contraction thereof. The tilt jack 21 has its cylinder 23 pivotally connected on a transverse axis to the main frame 11 and has its piston rod pivotally connected on a transverse axis to the mast 16. The lift jack supports the carriage through a chain 26 trained over a pulley 27 mounted on top of the lift jack piston.

When the lift jack is extended the carriage 17 and the attached forks 18 will raise the load 31 thereby creating a clockwise moment about pivot pins 22. This forward overturning moment is resisted by the tilt jack 21 and the pressure differential between the opposite ends of the tilt jack is proportional to the overturning moment.

Figure 2:
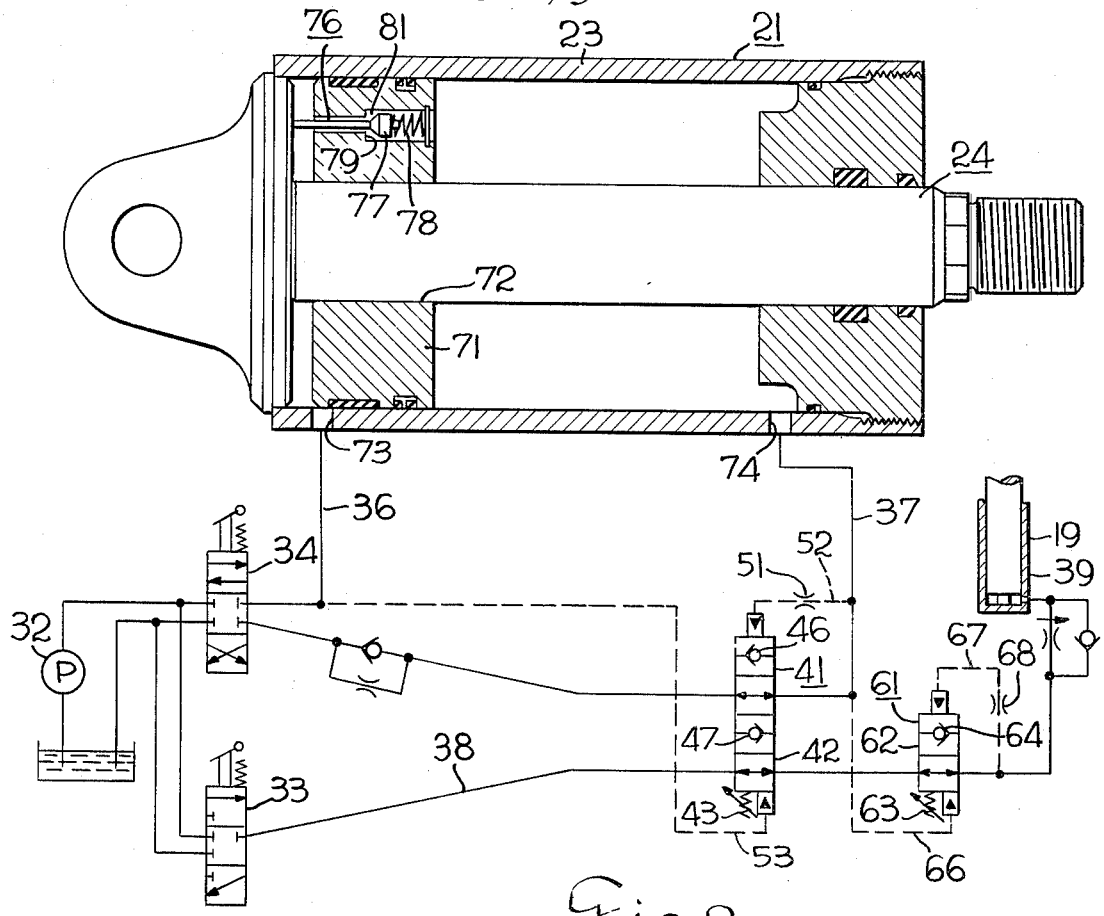
FIG. 2 is a schematic showing of the automatic overload control.

Referring to FIG. 2, the hydraulic control system for the lift and tilt jacks 19, 21 includes a pump 32, manually operable lift and tilt control valves 33, 34, a pair of tilt cylinder supply conduits 36, 37 interconnecting the tilt control valve 34 with the closed and rod ends of the tilt cylinder 23 and a lift supply conduit 38 interconnecting the lift control valve 33 with the bottom of the cylinder 39 of lift jack 19.

A first automatic differential pressure operated valve means in the form of blocking valve 41 is provided in the supply conduit 37 to the rod side of the tilt jack 21 and in supply conduit 38 to the lift jack 19. The valve 41 includes a flow control element 42 biased toward its illustrated open position by an adjustable spring means 43 and is biased in opposite directions by the pressure of hydraulic fluid in opposite ends of the tilt jack transmitted through pilot lines 52, 53. The pressure in the rod end of the tilt jack biases the valve flow control element toward its closed position wherein flow of fluid from the rod end of the tilt jack 21 is blocked and delivery of fluid to the lift jack 19 is prevented. Internal check valves 46, 47 permit contraction of the tilt and lift jacks 21, 19. Pressure modulating means in the form of a flow restrictor 51 is used in pilot line 52 to modulate the pressure to which the valve 41 is subjected and decrease the responsiveness of the valve.

A second differential pressure responsive valve means in the form of blocking valve 61 is provided in the lift jack supply line 38 intermediate the valve 41 and the lift jack 19. The valve 61 has a flow control element 62 biased toward its illustrated open position by adjustable spring means 63 and has its flow control element 62 biased in opposite directions by the fluid pressure in the rod end of the tilt jack and in the lift jack, such pressure being transmitted by way of pilot lines 66, 67, respectively. Pressure modulating means in the form of a flow restrictor 68 is incorporated in pilot line 67 to slow down the responsiveness of the flow control element 62 to fluctuations in lift jack pressure. As illustrated in FIG. 2, the tilt jack piston 71 has a bore 72 in which the piston rod 24 is gripped and has fluid supply ports 73, 74 at its opposite ends connected to the supply conduits 36, 37. Unloading valve means in the form of a spring loaded puppet valve 76 is provided in the piston 71 which includes a reciprocable poppet valve element 77 and a compression spring 78 biasing the element 77 toward a seated or closed position against a shoulder or seat 79 in an axial passage 81 through the piston. In the bottomed out condition in which the tilt jack 21 is shown in FIG. 2, the unloading valve means is in its open position, which condition results from the stem of the element 77 abutting the closed end of the cylinder 23 thereby moving the element 77 against the biasing action of spring 78 to its illustrated open position.

OPERATION

The lift truck mast 16 may be tilted rearwardly from its illustrated upright position through an angle *a* as permitted by contraction of the tilt jack 21 and may be tilted forwardly through an angle *b* as permitted by expansion of the tilt jack 21. During normal lift truck loading and unloading operations, the mast will be substantially upright or tilted rearwardly slightly. Through the range of mast tilt, the pressure will be greater in the rod end of the cylinder 23 than in the closed end and thus the unloading valve element 77 will be closed. Additionally, the spring 78 insures that the unloading valve remain closed even if the pressure in the closed end of the tilt jack should exceed the pressure in the rod end by some predetermined amount.

If the operator tilts the mast forwardly with a predetermined load on the forks, the pressure in the rod end of the tilt jack will increase because of the increased movement. When the differential pressure reaches some predetermined value representing an unsafe operating condition, the flow control element 42 of the pilot operated blocking valve 41 will be moved from its illustrated open position to its closed or blocking position against the biasing force of adjustable spring 43, thereby stopping tilting movement of the mast. At the same time the blocking valve flow control element 42 blocks flow to the lift jack 19. Thus when an unsafe forward overturning condition is approached, as measured by the differential pressure across the tilt jack 21, the automatic overload control means of this invention will prevent further forward mast tilting and elevation of the load. The restrictor 51 dampens pressure fluctuations thereby avoiding false actuation of the valve 41 in response to rapidly changing pressures. When the tilt jack 21 is fully contracted and its piston bottoms out the blocking valve 41 could be locked up in its closed position because of the excessively high pressure on the rod end of the tilt jack. In such a condition, it would not be possible to exhaust fluid from the rod end of the tilt jack 21. In order to prevent such a locked up condition, an end of the stroke unloading valve in the form of a spring loaded poppet valve 76 is provided. Thus, the pressure in the rod end of the tilt jack 21 will not exceed that caused by the moment of the mast and its payload.

When an excessive forward overturning moment is sensed by the pilot operated valve 41 the valve element 42 will move downwardly to its closed position overcoming the biasing effect of adjustable spring 43. In the blocking position fluid cannot be exhausted from the rod end of the tilt jack 21 by way of supply conduit 37 and fluid cannot be delivered to the lift jack 19 by way of supply conduit 38. One way valves in the form of check valves 46, 47 are provided which permit fluid to be delivered to the rod end of the tilt jack 21 to tilt the mast 16 rearwardly, thereby reducing the forward overturning moment and permit fluid to be exhausted from the lift jack 19 to lower the load.

When the tilt jack is bottomed out in its extended position, the overturning moment is resisted by the physical engagement between the piston and the rod end of the cylinder. If the operator now decides to pick up a heavy load that creates a hazardous forward overturning moment, the moment will not be sensed by the pressure differential across the tilt jack 21 and the blocking valve 41 will not close to prevent elevation of the load. In order to prevent raising of an excessive load in such an extended bottomed out condition of the tilt jack 21, a second differential pressure responsive control valve 61 is provided. The valve element 62 is biased to its illustrated open position by an adjustable force spring means 63 and is biased in opposite directions by the pressure in the lift jack and in the rod end of the tilt jack 21. When the pressure in the rod end of the tilt jack is zero or near zero, it is not possible to pick up an even normal load because the lift jack pressure will overcome the force of spring means 63 and shift the valve element 62 downwardly to its closed or blocking position. The operator must tilt the mast back at least a slight amount so that the pressure in the rod end of the tilt jack relates to the forward overturning moment. The pressure in pilot line 66 in such condition will assist the biasing spring means 63 in moving the valve element up to its illustrated open position. A check valve 64 is provided in the blocking valve 61 so that the load can be lowered when the lift jack is in a fully extended bottomed out condition. The restrictor 68 prevents rapid fluctuations of pressure from causing false actuation of the valve 61.

This invention provides a counterbalanced vehicle, such as a lift truck, with a completely hydraulic overload protection system which is inexpensive to manufacture and is simple to service and maintain in proper working order. The adjustable springs means 43, 63 permit the control to be adjusted to meet different requirements and allows the same control to be used on lift trucks with different load carrying specifications. The overload control device problems caused by bottoming out of the tilt cylinder have been satisfactorily solved by provision of the unloading valve 76 and the second automatic differential pressure sensing control valve 61.

The embodiments of the invention in which an exclusive property or privilege is claimed are defined as follows:

1. An overload protection system for a counterbalanced vehicle having a frame, a mast tiltable on the frame about a horizontal axis, a load support elevatable on the mast by a hydraulic lift jack and a double acting tilt jack having its opposite ends connected to the mast and the frame and operable to control the tilt of the mast, said system comprising:

a source of pressurized hydraulic fluid, a tilt control valve connected to said source, a lift control valve connected to said source, a pair of tilt jack supply passages connected to said tilt control valve and extended to and connected with opposite ends, respectively, of said tilt jack, a lift jack supply passage interconnecting said lift control valve and said lift jack, automatic differential pressure operated valve means in one of said tilt jack supply passages and in said lift jack supply passage having pilot connections with opposite sides of said tilt jack and operative to prevent expanstion of said tilt and lift jacks when the pressure differential across said tilt jack exceeds a predetermined value, a piston in said tilt jack, and an unloading valve in said piston automatically placing opposite axial sides thereof in fluid communication at the end of its retraction stroke.

2. The system of claim 1 and further comprising a second automatic differential pressure operated valve means in said lift jack supply passage including a flow control element biased by the lift jack pressure toward a closed position and biased by the pressure in the rod end of said tilt jack toward its open position.

3. The system of claim 2 wherein said second valve means includes adjustable spring means biasing said flow control element toward its open position.

4. The system of claim 1 wherein said one tilt jack supply passage is connected to the rod end of said tilt jack.

5. The system of claim 1 wherein said valve means includes a flow control element shiftable between open and closed positions and adjustable spring means biasing said flow control element toward its open position.

6. An overload protection system for a counterbalanced vehicle having a frame, a mast tiltable on the frame about a horizontal axis, a load support elevatable on the mast by a hydraulic lift jack and a double acting tilt jack having its opposite ends connected to the mast and the frame and operable to control the tilt of the mast, said system comprising:

a source of pressurized hydraulic fluid, a tilt control valve connected to said source, a lift control valve connected to said source, a pair of tilt jack supply passages connected to said tilt control valve and extended to and connected with opposite ends, respectively, of said tilt jack, a lift jack supply passage interconnecting said lift control valve and said lift jack, first automatic differential pressure operated valve means in one of said tilt jack supply passages and in said lift jack supply passage having pilot connections with opposite sides of said tilt jack and operative to prevent expansion of said tilt and lift jacks when the pressure differential across said tilt jack exceeds a predetermined value, and a second automatic differential pressure operated valve means in said lift jack supply passage including a flow control element biased by the lift jack pressure toward a closed position and biased by the pressure in the rod end of said tilt jack toward its open position, said second automatic differential pressure valve means is operative to prevent expansion of said lift jack when the lift jack pressure exceeds the rod end tilt jack pressure by a predetermined value.

7. The system of claim 6 wherein said second valve means ind udes adjustable spring means biasing said flow control element toward its open position.

8. The system of claim 7 wherein said first valve means includes a flow control element shiftable between open and closed positions and adjustable spring means biasing said flow control element toward its open position.

9. The system of claim 8 and further comprising pressure modulating means associated with said first and second valve means, respectively, operative to prevent false actuation of said valve means caused by rapid fluctuations of pressure.

* * * * *